United States Patent [19]

Hatch

[11] 4,095,862

[45] Jun. 20, 1978

[54] METHOD AND APPARATUS FOR CONNECTING FLAT CABLE

[75] Inventor: David A. Hatch, Sherborn, Mass.

[73] Assignee: Pin Tek, Inc., Sherborn, Mass.

[21] Appl. No.: 733,949

[22] Filed: Oct. 19, 1976

[51] Int. Cl.[2] ..... H01R 3/06

[52] U.S. Cl. ..... 339/14 R; 339/22 B; 339/97 R

[58] Field of Search ..... 339/14 R, 14 RP, 17 F, 339/22 B, 97, 99

[56] References Cited

U.S. PATENT DOCUMENTS

| | | | |
|---|---|---|---|
| 3,707,696 | 12/1972 | Carter | 339/17 F |
| 3,713,073 | 1/1973 | Narozny | 339/17 F |
| 3,768,067 | 10/1973 | Rault | 339/14 R X |
| 3,816,818 | 6/1974 | Meier | 339/17 F X |
| 3,904,261 | 9/1975 | Cooney | 339/14 R X |

*Primary Examiner*—Roy Lake
*Assistant Examiner*—DeWalden W. Jones
*Attorney, Agent, or Firm*—John E. Toupal

[57] ABSTRACT

Disclosed is an electrical connector composed of a dielectric housing that defines an internal cavity, cable openings for receiving the ends of a pair of flat ribbon cables with alternating ground and signal wires, and conductor openings for receiving conductor elements to be connected to the conductive wires in the flat cables. Located in the cavity is a first grounding bus for electrically connecting together the alternate ground wires in one of the cables and a second grounding bus for electrically connecting together the alternate ground wires in the other cable. Also retained within the cavity are a plurality of electrically isolated coupling elements each operative to electrically connect one of the conductor elements with a different one of the alternate signal wires in the two cables. Finally a ground output means connects the first and second grounding busses to at least one conductor element so as to connect all of the ground wires to a circuit common outside the connector.

32 Claims, 16 Drawing Figures

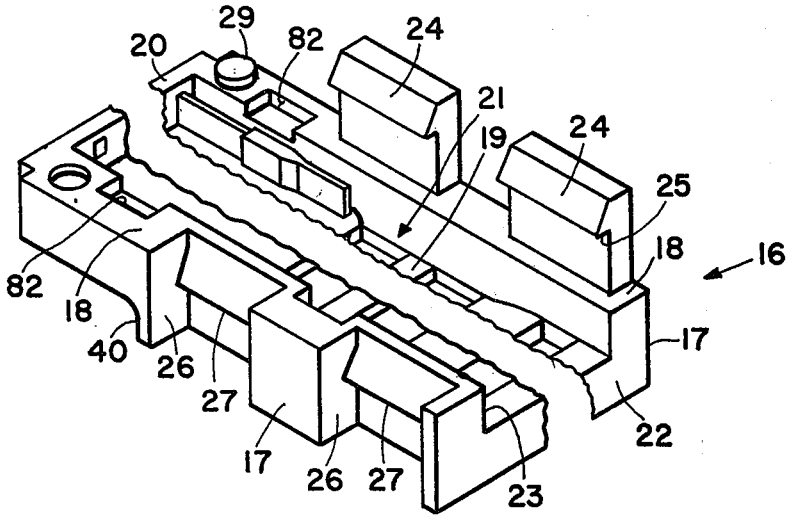
FIG. 1
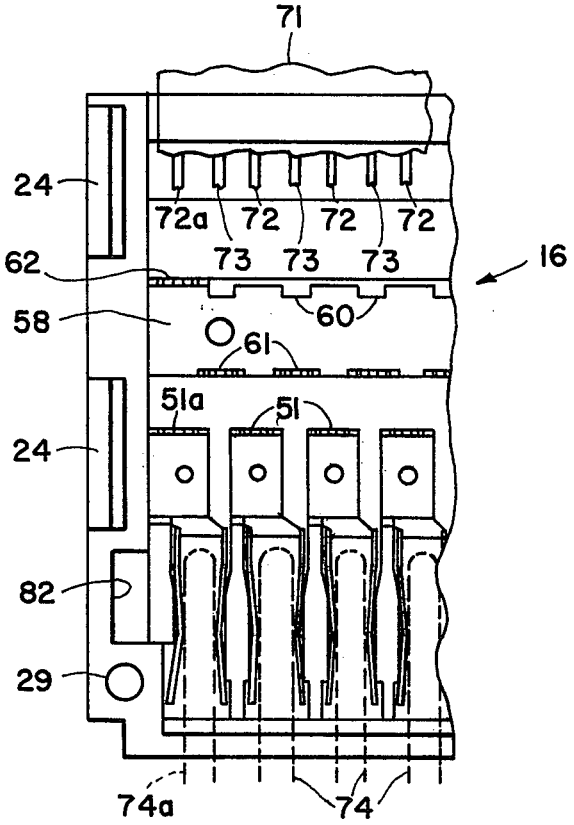
FIG. 11
FIG. 16
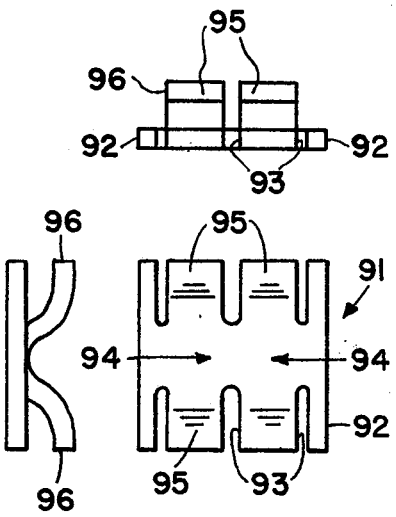
FIG. 15 FIG. 14

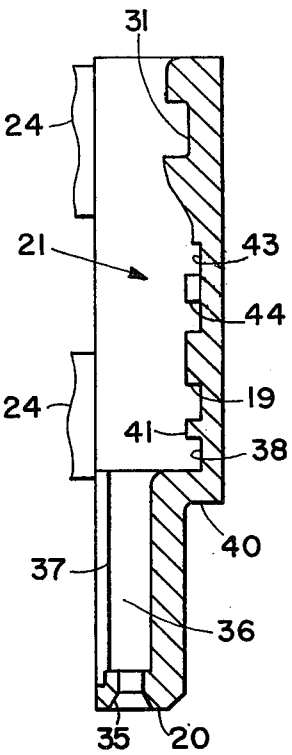
FIG. 4
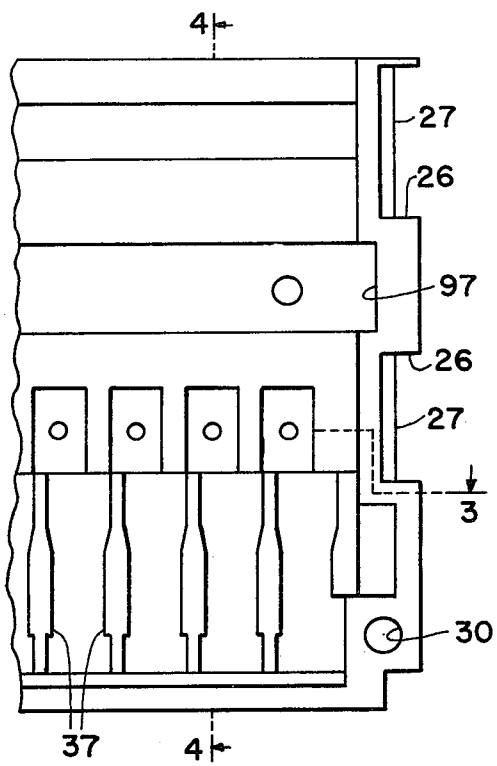
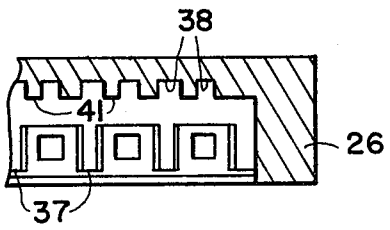
FIG. 3
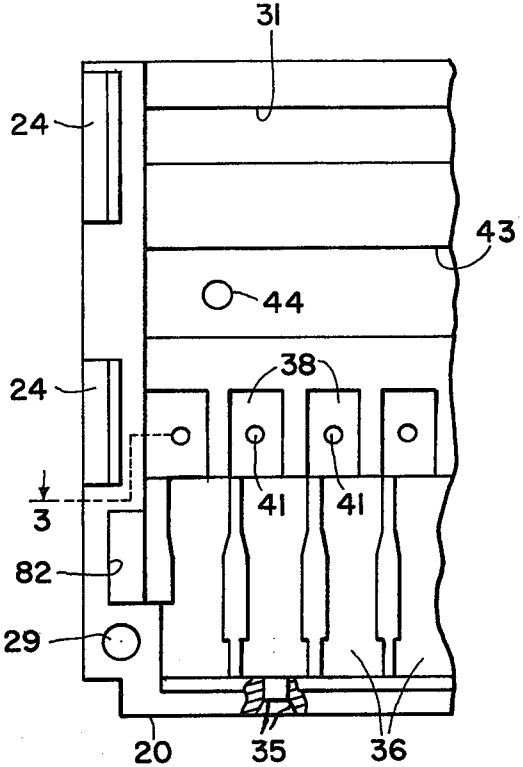
FIG. 2
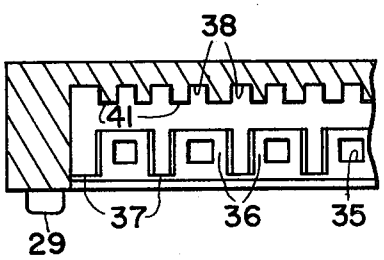

METHOD AND APPARATUS FOR CONNECTING FLAT CABLE

BACKGROUND OF THE INVENTION

This invention relates to connectors for use with flat ribbon cables which include a large number of spaced apart, parallel conductive wires retained within a flexible insulative sheath.

Flat ribbon cables are used extensively in the wiring of printed circuits and other intricate electrical and electronic systems. Such cables greatly simplify the interconnection of circuits in electrical processes employing a multitude of independent signal lines. In addition, by grounding alternate wires in each cable, electrical interference or cross talk between adjacent signal lines can be greatly diminished. Although they offer many advantages, the procedures normally required to complete circuits with flat ribbon cable are tedious and time consuming. Accordingly, there is a great need for connectors that can simplify these procedures.

The object of this invention, therefore, is to provide an electrical connector that will both improve and simplify the use of flat ribbon cable.

SUMMARY OF THE INVENTION

The invention is an electrical connector composed of a dielectric housing that defines an internal cavity, cable openings for receiving the ends of a pair of flat ribbon cables with alternating ground and signal wires, and conductor openings for receiving conductor elements to be connected to the conductive wires in the flat cables. Located in the cavity is a first grounding bus for electrically connecting together the alternate ground wires in one of the cables and a second grounding bus for electrically connecting together the alternate ground wires in the other cable. Also retained within the cavity are a plurality of electrically isolated coupling elements each operative to electrically connect one of the conductor elements with a different one of the alternate signal wires in the two cables. Finally a ground output means connects the first and second grounding busses to at least one conductor element so as to connect all of the ground wires to a circuit common outside the connector. In a preferred embodiment the first and second busses are connected together within the cavity so as to permit external commoning of both busses via a single conductor element. By accommodating a pair of flat ribbon cables and internally connecting the alternate ground wires thereof, the present connector provides an output signal density approximately twice that exhibited by conventional flat cable connectors.

In a preferred embodiment of the invention, the dielectric housing comprises a pair of identical mating parts separated by a divider that divides the cavity into first and second cavity portions that each receive one of the individual flat cables that enter one end of the housing in a longitudinally parallel relationship. The conductor elements enter conductor openings in the opposite end of the housing and connect with the coupling elements which are arranged in rows extending transversely to the cables. The coupling elements in the first cavity portion are positioned to connect with the alternate signal wires in one of the cables and the coupling elements in the second cavity portion are positioned to connect with the alternate signal wires in the other cable. Similarly arranged in each cavity portion is a row of ground contacts extending parallel to the row of coupling elements therein and longitudinally spaced therefrom. The ground contacts in one of the cavity portions are connected to the first grounding bus and are disposed for connection to the alternate ground wires in one of the cables while the ground contacts in the other cavity portion are connected to the second ground bus and disposed for connection to the alternate ground wires in the other cable. Preferably, both the coupling elements and the ground contacts include piercing portions that penetrate the insulative sheath on the cables so as to make electrical contact with the conductive wires embedded therein.

One feature of the invention is the provision of a stress relief mechanism that will accommodate different gauged flat ribbon cable. The stress relief mechanism comprises elongated rods located within the cavity adjacent the cable openings so as to forcibly engage the received cables along contact lines extending transversely to the retained conductor wires. By merely selecting a stress relief rod of appropriate diameter, the same connector can be employed with any of a variety of different gauged flat ribbon cables. In addition, the rods enhance the structural integrity of the housing.

The invention further entails a method for making an electrical connector for use with flat ribbon cable. According to the method there is formed a dielectric housing with an internal cavity, a cable opening for accommodating an end of flat ribbon cable and conductor openings for receiving a plurality of conductor elements. Also formed are a plurality of coupling elements each adapted to provide electrical connection between one of the conductive wires in the cable and one of the conductor elements. The coupling elements are mounted within the cavity in electrically isolated positions located so as to electrically receive a different one of the conductive wires. Next there is formed an electrically conductive bus for electrically connecting together a plurality of the conductive wires. The bus is mounted within the cavity in a position to electrically receive given wires in the cable not connected to the coupling elements. Finally formed is a ground output means for selectively providing electrical connection between the bus and any one of the coupling contacts. After selecting one of the conductor elements as a ground conductor, the ground output means is mounted within the cavity in a position to electrically connect the bus to that particular coupling contact that receives the selected conductor element. The method provides for interconnection of a plurality of ground lines within the connector and permits selection of any of a plurality of output conductors for use in connecting the ground wires to an external common.

In a preferred embodiment of the above method, the ground output means comprises a plurality of ground output contacts formed integrally with the bus and each located thereon so as to electrically connect the bus to a different one of the coupling contacts. Before mounting the bus in the cavity, only that ground output contact associated with the selected coupling contact is rendered operative for producing an electrical connection therebetween. In a preferred embodiment of this method all the nonselected ground output contacts are made inoperative by being removed from the bus prior to its mounting in the cavity.

DESCRIPTION OF THE DRAWINGS

These and other objects and features of the present invention will become more apparent upon a perusal of the following description taken in conjunction with the accompanying drawings wherein:

FIG. 1 is an isometric view of one mating half of a connector housing according to the invention;

FIG. 2 is a partial plan view of the housing half shown in FIG. 1;

FIG. 3 is a partial cross-sectional view taken along lines 3—3 of FIG. 2;

FIG. 4 is a cross-sectional view taken along lines 4—4 of FIG. 2;

FIG. 11 is a partial view of the housing shown in FIGS. 1–4 after receiving a plurality of the contacts shown in FIGS. 5–7 and the grounding bus illustrated in FIGS. 8–10;

FIG. 14 is a plan view of a grounding element for interconnecting the grounding busses in both halves of the connector;

FIG. 15 is a side view of the element shown in FIG. 14; and

FIG. 16 is an end view of the element shown in FIGS. 14 and 15.

DESCRIPTION OF THE PREFERRED EMBODIMENT

Figure 5:
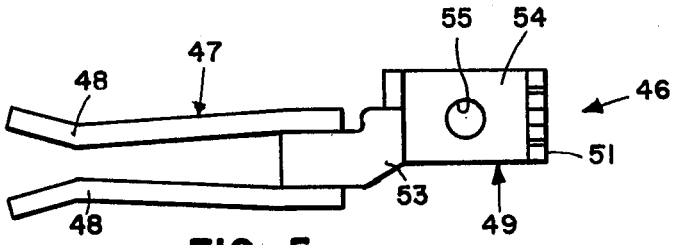
FIG. 5 is a plan view of a coupling contact used in the housing shown in FIGS. 1–4.

Referring now to FIG. 1 there is shown a body portion 16 that forms one half of a connector housing. The body 16 includes side walls 17 with upper surfaces 18, a bottom wall 19 and an end wall 20 that define an open-sided cavity 21. An opposite end wall 22 is recessed to form an opening 23 for receiving an end of a flat ribbon cable. As described below, the cavity 21 also accommodates contacts that connect to the individual conductive wires in the cable.

Extending out of one of the surfaces 18 are a pair of projections 24 having re-entrant latch surfaces 25. A pair of openings 26 are formed in the opposite side wall 17 and each includes a projecting catch 27. During assembly of a complete connector the projections 24 of one body portion 16 are forced into the openings 26 of an identical body portion 16. As they enter the openings 26, the projections 24 are sprung outwardly by engagement with the catches 27 and after passing therebeyond spring back inwardly producing engagement between the latching surfaces 25 and the undersurfaces 28 of the catches 27. In this way a pair of identical body portions 16 are latched together to form a composite connector housing. Proper alignment between mating halves is enhanced by engagement between a pin 29 on one body portion and an accommodating cavity 30 on the other.

Referring now to FIGS. 2–4 there is shown in greater detail the body portion 16 illustrated in FIG. 1. Formed at one end of the body 16 adjacent the cable opening 23 is an elongated groove 31 that snugly retains a rod 32 made of a suitable rigid material such as steel. As described below, an upper surface 33 of the rod 32 forcibly engages so as to provide stress relief to a received flat cable upon assembly of a complete connector.

Formed in the end wall 20 are a plurality of conically shaped conductor openings 35 for accommodating entry into the cavity 21 of conductor pins in a compatible circuit board header (not shown). The inner and smaller ends of the conductor openings 35 communicate with contact chambers 36 formed in the cavity 21 by parallel, spaced apart isolating walls 37 extending out of the bottom wall 19. A plurality of auxiliary chambers 38 slightly offset from the chambers 36 are formed by spaced apart recesses in the bottom wall 19. Each adjacent pair of chambers 36 and 38 forms a composite chamber that receives a coupling contact as described more fully hereinafter. For securing these contacts a stud 41 extends out of the bottom wall 19 in each of the auxiliary chambers 38. A recess extending transversely to the isolating walls 37 forms another chamber 43 for receiving a grounding bus in a manner described below. Provided in the chamber 43 are a plurality of studs 44 for securing the grounding bus in place. As shown in FIG. 4, the step 40 separates that portion of the housing 16 defining the chambers 36 and the remainder of the housing. For this reason one portion of the housing 16 has a narrow profile that is compatible with conventional connector headers while the remainder of the housing 16 has a wider profile that facilitates its use in a composite connector that accepts a pair of flat ribbon cables as described hereinafter.

Figure 6:
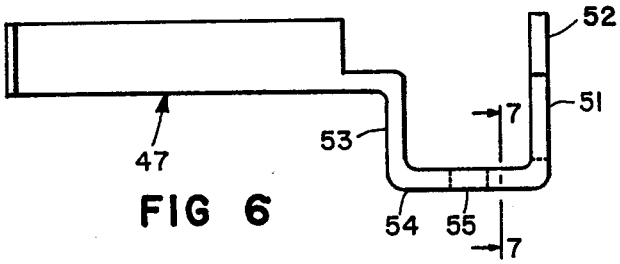
FIG. 6 is a side view of the coupling contact shown in FIG. 5.
Figure 7:
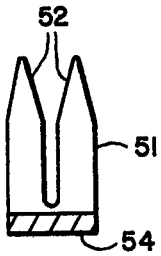
FIG. 7 is a sectional view of the coupling contact shown in FIG. 5 taken along lines 7—7.

FIGS. 5–7 illustrate a coupling element 46 used in the connector body 16 shown in FIGS. 1–4. The coupling element 46 comprises a rear portion 47 formed by spring contacts 48 adapted to receive a conductor pin and a forward portion 49 including an upright signal contact 51 having edges 52 adapted to pierce the insulative sheath of a cable and contact a conductive wire retained therein. Formed in a flat base 54 of the front portion 49 is a retainer hole 55 that receives the stud 41 shown in FIGS. 2 and 4. The rear and front portions 48 and 49 of the coupling element are joined by a vertically oriented segment 53.

Figure 8:
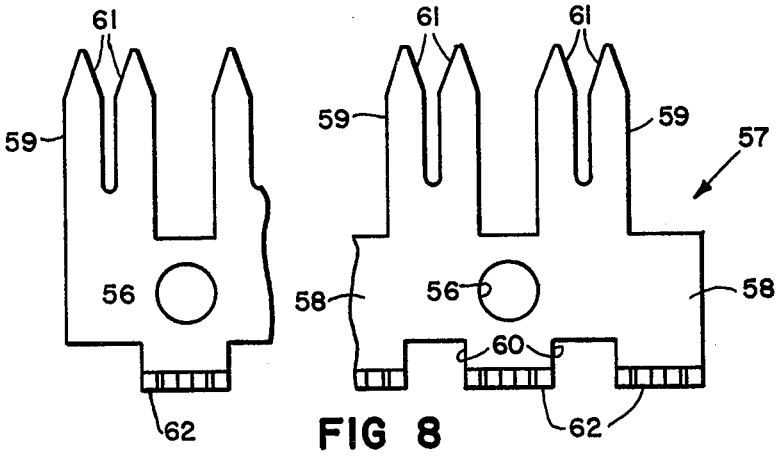
FIG. 8 is a partial plan view of a grounding bus used in the housing shown in FIGS. 1–4.
Figure 9:
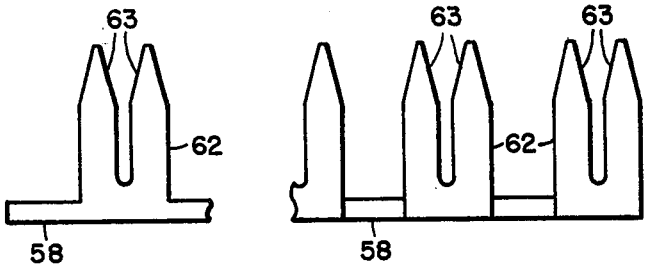
FIG. 9 is a partial side view of the grounding bus shown in FIG. 8.
Figure 10:
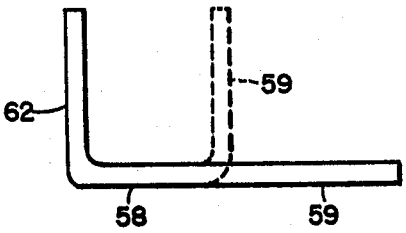
FIG. 10 is an end view of the grounding bus shown in FIGS. 8 and 9.

FIGS. 8–10 are views illustrating a grounding bus 57 used in the connector body 16 shown in FIGS. 1–4. The bus 57 comprises an elongated flat base 58 with a plurality of retaining holes 56 that receive the studs 44 shown in FIGS. 2 and 4. Extending from one edge of the base 58 are a plurality of equally spaced apart ground contacts 59. Prior to insertion in the body 16, the contacts 59 are bent vertically to the base as shown by dotted lines in FIG. 10. Each of the ground contacts 59 has upper terminal portions 61 adapted to pierce the insulative sheath on flat ribbon cable and engage the conductive wires retained therein. A plurality of equally spaced apart ground output contacts 62 extend from the opposite edge of the base 58 in locations between each pair of the ground contacts 59. The ground output contacts 62 are also bent vertically and include upper terminal portions 63 adapted to pierce a flat cable. Before the grounding bus 57 is mounted within the body 16, one of the ground output contacts 62 is selected to provice an external ground connection. All non-elected ground output contacts 62 are then rendered ineffective, preferably by being sheared from the base 58. To facilitate this operation the base 58 is provided with notches 60 between each pair of the ground output contacts 62.

Referring now to FIG. 11 there is partially depicted the connector body 16 after mounting of coupling elements 46 (FIGS. 5–7) and the grounding bus 57 (FIGS. 8–10) within the cavity 21. As shown, the rear portion 47 of each coupling element 46 is received in a chamber 36 while the front portion 49 thereof is received by an adjacent chamber 38. The difference in height between the chambers 36 and 38 is accommodated by the vertical segments 53 that join the front and rear portions of the elements 46. Securing the mounted elements 46 in position are the studs 41 which are received by the openings 55 in the bases 54 of all elements. The base 58 of the grounding bus 57 is mounted in the chamber 43 and is secured therein by the studs 44 that penetrate openings 56 in the base. As shown in FIG. 11 the ground contacts 59 on the grounding bus 57 and the signal contacts 51 on the coupling elements 46 are uniformly shifted with respect to each other along the length of the base 58 such that each ground contact 59 is directly between a spaced apart pair of adjacent signal contacts 51. Conversely, the preselected ground output contact 62 that was not removed from the grounding bus 57 is directly aligned with the first signal contact 51*a* in a direction transverse to the base 58 of the grounding bus 57. It will be noted that any of the removed ground contacts 62 would have been similarly aligned with a signal contact 51 had it not been removed from the bus 57.

As indicated by dotted lines in FIG. 7, a flat ribbon cable 71 is received by the cavity 21 in the body portion 16. The cable 71 is formed of a suitable electrical insulation material that encapsulates a plurality of longitudinally parallel conductive wires 72. The components within the body portion 16 are positioned such that one set of alternating wires 72 in the cable 71 aligns with the signal contacts 51 while the other alternate wires 73 align with the ground contacts 61. During assembly of a connector the cable 71 is forced against the contacts 51 and 61 causing the contact edges 52 and 61 to pierce the insulative sheath on the cable and electrically engage the conductive wires embedded therein. Thus, each of the signal wires 72 will be electrically connected to a different one of the signal contacts 51 and each of the ground wires 73 will be connected to a different one of the ground contacts 61. The end signal wire 72*a*, however, will make electrical contact with both the preselected ground output contact 62 and the signal contact 51*a* thereby connecting that contact to the grounding bus 58. Each of a plurality of conductor pins 74 on a mating header (not shown) will be connected by one of the coupling elements 46 to a different one of the signal wires 72 which would be used to transmit signals. A conductive pin 74*a*, however, would connect an external common to all of the ground wires 73 via the grounding bus 57, the grounding contacts 61, the selected ground output contact 62, the end signal wire 72*a* and the signal contact 51*a*.

Figure 12:
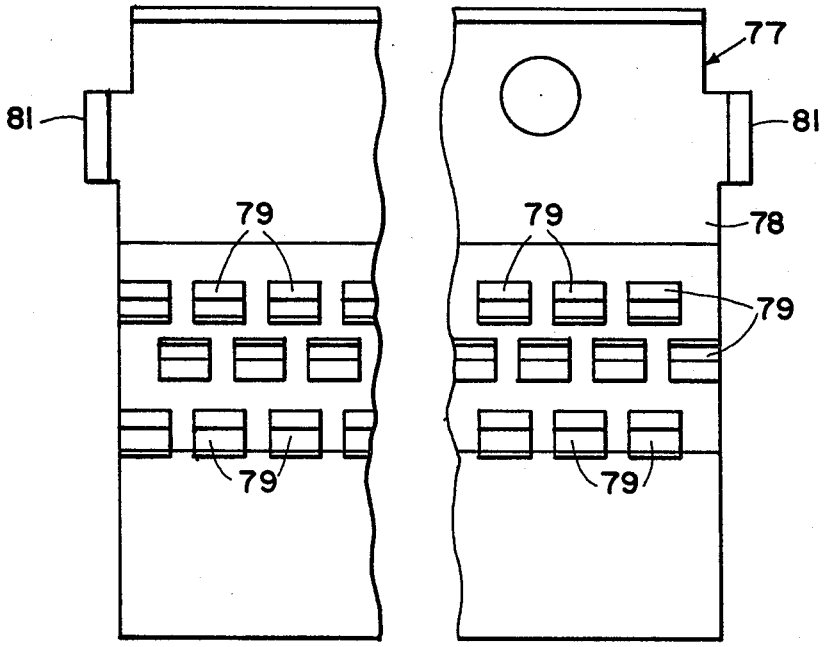
FIG. 12 is a plan view of a divider element for use between a pair of the housings shown in FIGS. 1–4.
Figure 13:
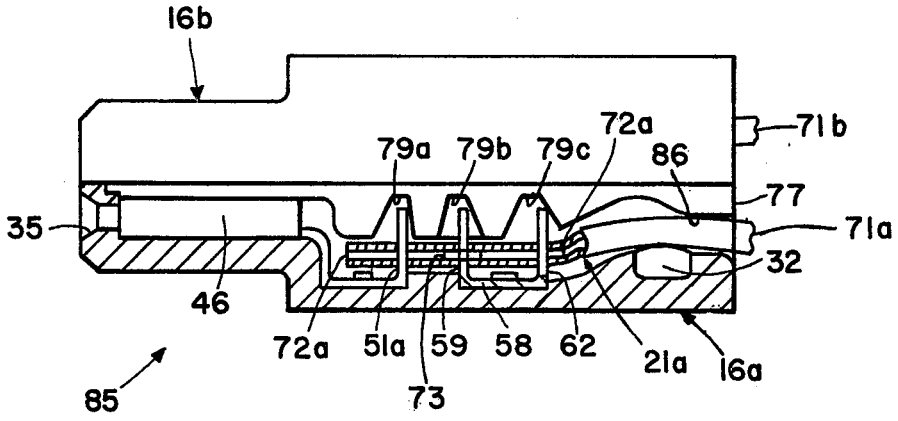
FIG. 13 is a cross-sectional view of a complete connector retaining a pair of flat ribbon cables.

FIG. 12 is a plan view of a divider part 77 used with a pair of the body portions 16. The upper surface 78 of the divider 77 defines three rows of recesses 79*a*, 79*b* and 79*c*. As described below, upon assembly of a complete connector unit each of the recesses is positioned to receive the insulation piercing portions 52, 61, 63 of one of the contacts 51, 59 or 62. The bottom surface of the divider 77 defines an identical set of recesses 79 as shown in FIG. 13. Extending from opposite edges of the divider 77 are shoulders 81 that are received by accommodating recesses 82 in the body portions 16.

FIG. 13 depicts a preferred form of complete connector 85 according to the invention. The complete connector 85 includes a body portion 16*a* shown in section and a mating body portion 16*b* shown in elevation. Each of the body portions 16*a* and 16*b* is identical to the body shown in FIGS. 7–10 and engagement between the body portions is along their open sides which are thereby closed. The bodies 16*a* and 16*b* define a composite cavity that is separated into a first cavity portion 21*a* within the body 16*a* and a second identical cavity portion within the body 16*b* by the divider part 77.

As shown, the divider recesses 79*a* are aligned with and receive the signal contacts 51, the recesses 79*b* are aligned with and receive the ground contacts 59 and one of the recesses 79*c* is aligned with and receives the selected ground output contact 62. As noted above, the upper surface of the divider 77 is identical to the lower surface shown in FIG. 13 and similarly receives contacts in the body 16*b*. Entering openings in the connector 85 formed between the recessed end walls of the parts 16*a* and 16*b* and the divider part 77 is a pair of flat cables 71*a* and 71*b*. The piercing portions 52, 61 and 63, respectively, of the signal contacts 51, the ground contacts 59 and the ground output contact 62 extend perpendicular to a planar region occupied by the cable 71*a*. Thus, the cable 71*a* is pierced by the piercing portions in response to relative movement between the cable 71*a* and the body portion 16*a* in a direction transverse to that planar region. As schematically illustrated in FIG. 13, the end conductor wire 72*a* contacts both the selected ground output contact 62 and the directly aligned signal contact 51*a* while the partially cutaway ground wire 73 is electrically connected to the ground contact 59. The remaining wires in the cable 71*a* are alternately connected to either ground contacts 59 or signal contacts 51 as described above. Strain relief for the cable 71*a* is provided by its forcible engagement between a transverse rib 86 on the divider 77 and the transverse rod 32. Appropriate stress relief for cables of different gauge can be selected by merely selecting a rod 32 of a suitable diameter. It will be appreciated that the cable 71*b* is identically stress relieved and electrically interconnected within the body portion 16*b* by contact piercing portions (not shown) that are disposed vis-a-vis the piercing portions in the body portion 16*a*.

FIGS. 14–16 are schematic views of a grounding element 91 for electrically connecting the grounding bus 57 in the body portion 16*a* to the identical grounding bus (not shown) in the body portion 16*b*. The element 91 is a flat plate 92 formed with a suitable electrically conductive spring material. Slots 93 extend from opposite edges of and divide the plate 92 into a pair of bifurcated sections 94. The bifurcated sections are bent away from the plate 92 to form spring clips 95 having ends 96. Prior to assembly of a complete connector, the plate 92 of the element 91 is press fitted into notches 97 framed in the side walls of the body portions 16. The arms 95 extend slightly into the cavities 21 and the ends 96 enter the chambers 43. Upon assembly of a connector unit 85 as shown in FIG. 13, the oppositely projecting ends 96 of the element 91 electrically engage the grounding busses 57 retained within the chambers 43.

Because both busses are interconnected internally, a single coupling element 47 can be used to connect an external circuit common to all of the ground wires in both body halves 16*a* and 16*b*. Thus, all other outputs of the complete connector 85 can be used for signals establishing a much higher signal output density than is available with conventional ribbon cable connectors.

Another feature of this invention is a method by which any of the coupling elements 46 can be employed as a ground output terminal. As shown in FIGS. 8–10, prior to assembly the grounding bus 57 is a flat conductive strip including an elongated base portion 58. A plurality of spaced apart ground contacts 59 extend from one edge of the base 58 while a plurality of spaced apart ground output contacts 62 extend from the opposite edge thereof. Upon placement of the base 58 in the recess 43 in the body 16 as shown in FIG. 11, each of the ground output contacts 62 would be in alignment with one of the retained signal contacts 51. Before insertion of a bus 57, however, one determines which particular coupling element 46 will be connected to an external circuit common. Next, the particular ground output contact that will be aligned with the signal contact 51 associated with the selected coupling element 46 is determined. All other output ground contacts 62 are then sheared from the base plate 58. For example, in the connector illustrated in FIG. 11 only the end ground output contact 62 remains effective and all other ground output contacts have been sheared along lines joining the slots 60 in the base portion 58. Thus, the end coupling element 51*a* is connected to the bus 57 and serves as a ground output terminal. It will be obvious that a grounding bus providing a ground output to any of the other coupling elements 47 could be similarly formed by appropriate choice of a ground output contact 62 aligned therewith and similar removal of all other ground output contacts from the base plate 57.

Obviously, many modifications and variations of the present invention are possible in light of the above teachings. It is to be understood, therefore, that the invention can be practiced otherwise than as specifically described.

What is claimed is:

1. An electrical connector for flat ribbon cable having a plurality of transversely spaced elongate conductive wires within an insulative sheath and comprising:

dielectric housing means defining an internal cavity, cable openings for accommodating entry into said cavity of ends of a pair of parallel longitudinally aligned flat ribbon cables, and conductor openings for accommodating entry into said cavity of a plurality of conductor elements, said housing means comprising a first housing part having an open side and defining a first cavity portion of said cavity and a second housing part having an open side and defining a second cavity portion of said cavity, said first and second housing parts being engaged to close said open sides;

a distinct divider part positioned within said cavity so as to electrically isolate said first cavity portion from said second cavity portion;

first grounding means retained within said first cavity portion and operative to electrically connect together a plurality of conductive wires in one of the cables;

second grounding means retained within said second cavity portion and operative to electrically connect together a plurality of conductive wires in the other cable;

a first plurality of electrically isolated coupling elements retained within said first cavity portion and each operative to electrically connect a different one of said conductive wires in the one cable to a respective different one of the conductor elements; and a second plurality of electrically isolated coupling elements retained within said second cavity portion and each operative to electrically connect a different one of said conductive wires in the other cable to a respective different one of the conductor elements.

2. An electrical connector according to claim 1 wherein said first grounding means is operative to electrically connect together alternate conductive wires in the one cable, and said second grounding means is operative to electrically connect together alternate conductive wires in the second cable.

3. An electrical connector according to claim 2 wherein said first plurality of coupling elements connect to signal conductive wires in the one cable that alternate with the alternate conductive wires connected together by said first grounding means, and said second plurality of coupling elements connect to signal conductive wires in the other cable that alternate with the alternate conductive wires connected together by said second grounding means.

4. An electrical connector according to claim 3 including ground output means for connecting said first grounding means to at least one of the conductor elements and said second grounding means to at least one of the conductor elements.

5. An electrical connector according to claim 4 wherein said ground output means comprises means for connecting said first and second grounding means to at least one of the signal conductive wires.

6. An electrical connector according to claim 5 wherein said cable openings are defined by one end of said housing and said conductor openings are defined by an opposite end thereof.

7. An electrical connector according to claim 5 wherein said first plurality of coupling elements are arranged in a row extending transversely to the one cable and with each element aligned with one of the signal wires, said first grounding means comprises a first plurality of interconnected ground terminals arranged in a row extending transversely to the one cable and longitudinally spaced from said row of first elements, said ground terminals being aligned with the alternate conductive wires of the one cable, said second plurality of coupling elements are arranged in a row extending transversely to the other cable and with each element aligned with one of the signal wires, said second grounding means comprises a second plurality of interconnected ground terminals arranged in a row extending transversely to the one cable and longitudinally spaced from said row of second elements, said ground terminals being aligned with the alternate conductive wires of the other cable.

8. An electrical connector according to claim 1 including means within said cavity for connecting said first grounding means to said second grounding means.

9. Electrical connector according to claim 5 wherein said first pluralities of coupling elements and ground terminals comprise first stationary piercing portins extending in one direction toward a planar region occupied by the one cable, said second pluralities of coupling elements and ground terminals comprise second stationary piercing portions disposed vis-a-vis said first piercing portions and extending toward said planar region in a direction opposite said one direction, and said first piercing portions are adapted to pierce the one cable and said second piercing portions are adapted to pierce the other cable in response to relative movement between the cables and said mating parts in a direction transverse to said planar region.

10. An electrical connector according to claim 9 wherein each of said coupling elements and said ground terminals comprise bifurcated portions that straddle said wires and the opposite sides of said divider part comprise a plurality of recesses that receive and retain so as to prevent separation of said bifurcated portions.

11. An electrical connector according to claim 10 wherein said one end of said housing is substantially wider than said opposite end in a direction transverse to said rows of elements and terminals.

12. An electrical connector according to claim 1 including a stress relief rod means retained by said housing means within said cavity, said rod means being disposed between said grounding means and said cable openings and adapted to exert a holding force on the flat ribbon cables.

13. An electrical connector according to claim 12 wherein said rod means comprises a first removable rod for engaging one of the cables and extending transversely to the conductive wires therein, and a second removable rod for engaging the other cable and extending transversely to the conductive wires therein.

14. An electrical connector for flat ribbon cable having a plurality of transversely spaced elongate conductive wires within an insulative sheath and comprising:

dielectric housing means defining an internal cavity, a cable opening for accommodating entry into said cavity of an end of a flat ribbon cable, and conductor openings for accommodating entry into said cavity of a plurality of conductor elements;

grounding means retained within said cavity and operative to electrically connect together a plurality of conductive wires in the cable;

a plurality of electrically isolated coupling elements retained within said cavity and each operative to electrically connect a different one of said conductive wires in the cable to a respective different one of the conductor elements; and selective means for selectively connecting said grounding means to any of a plurality of said coupling elements.

15. An electrical connector according to claim 14 wherein said selective means comprises means for selectively connecting said grounding means to any of a plurality of said different conductive wires connectable to said coupling elements and the conductor elements.

16. An electrical connector according to claim 15 wherein said internal cavity comprises cable openings for accommodating entry into said cavity of ends of a pair of parallel longitudinally aligned flat ribbon cables, said grounding means comprises first grounding means retained within said cavity and operative to electrically connect together a plurality of conductive wires in one of the cables and second grounding means retained within said cavity and operative to electrically connect together a plurality of conductive wires in the other cable; and said coupling elements comprise a first plurality of electrically isolated coupling elements retained within said cavity and each operative to electrically connect a different one of said conductive wires in the one cable to a respective different one of the conductor elements and a second plurality of electrically isolated coupling elements retained within said cavity and each operative to electrically connect a different one of said conductive wires in the other cable to a respective different one of the conductor elements.

17. An electrical connector according to claim 16 wherein said first grounding means is operative to electrically connect together alternate conductive wires in the one cable, and said second grounding means is operative to electrically connect together alternate conductive wires in the second cable.

18. An electrical connector according to claim 17 wherein said first plurality of coupling elements connect to signal conductive wires in the one cable that alternate with the alternate conductive wires connected together by said first grounding means, and said second plurality of coupling elements connect to signal conductive wires in the other cable that alternate with the alternate conductive wires connected together by said second grounding means.

19. An electrical connector according to claim 18 wherein said cable openings are defined by one end of said housing and said conductor openings are defined by an opposite end thereof.

20. An electrical connector according to claim 19 wherein said one end of said housing is substantially wider than said opposite end in a direction transverse to said rows of elements and terminals.

21. An electrical connector according to claim 16 including means within said cavity for connecting said first grounding means to said second grounding means.

22. A method for making an electrical connector for flat ribbon cable having a plurality of transversely spaced elongate conductive wires within an insulative sheath and comprising the steps of:

forming a dielectric housing with an internal cavity, a cable opening for accommodating entry into said cavity of an end of the first ribbon cable, and conductor openings for accommodating entry into said cavity of a plurality of conductor elements;

forming a plurality of coupling elements each adapted to provide electrical connection between one of the conductive wires and one of said conductor elements;

mounting within said cavity said plurality of coupling elements in electrically isolated positions each located to electrically receive a different one of the conductive wires in the cable;

forming bus means for electrically connecting together a plurality of the conductive wires;

mounting within said cavity said bus means in a position to electrically receive given wires in the cable not received by said coupling elements;

forming ground output means adapted to provide electrical connection between said bus means and any one of a plurality of said coupling elements;

selecting a particular one of said plurality of coupling elements for use as a ground output; and mounting within said cavity said ground output means in a position to electrically connect said particular coupling element to said bus means.

23. A method for making an electrical connector according to claim 22 wherein said forming steps comprise forming said bus means and said ground output means as an integral unit.

24. A method for making an electrical connector according to claim 23 wherein said forming steps comprise forming said bus with a plurality of grounding portions each disposed to electrically connect said bus means to a different one of said plurality of coupling elements, and operating on said bus means so as to make operative only that specific grounding portion disposed to connect said bus means to said particular coupling elements.

25. A method for making an electrical connector according to claim 24 wherein said forming steps comprise removing from said bus means said grounding portions other than said specific grounding portion.

26. An electrical connector for flat ribbon cable having a plurality of transversely spaced elongate conductive wires within an insulative sheath and comprising:

dielectric housing means formed by identical mating body portions defining first and second internal cavities, said body portions further defining cable openings for accommodating entry into each of said cavities one of a pair of parallel longitudinally aligned flat ribbon cables, and conductor openings for accommodating entry into said cavity of a plurality of conductor elements;

first grounding means retained within said first cavity and operative to electrically connect together a plurality of conductive wires in one of the cables;

second grounding means retained within said second cavity and operative to electrically connect together a plurality of conductive wires in the other cable;

a first plurality of electrically isolated coupling elements retained within said first cavity and each operative to electrically connect a different one of said conductive wires in the one cable to a respective different one of the conductor elements; and a second plurality of electrically isolated coupling elements retained within said second cavity and each operative to electrically connect a different one of said conductive wires in the other cable to a respective different one of the conductor elements.

27. An electrical connector according to claim 26 including means within said cavity for connecting said first grounding means to said second grounding means.

28. An electrical connector according to claim 26 wherein said body portions are separable, and said first and second grounding means and said plurality of coupling elements are operative to produce said electrical connections in response to relative transverse movement between the cables and said body portions.

29. An electrical connector for flat ribbon cable having a plurality of transversely spaced elongate conductive wires within an insulative sheath and comprising:

separable housing portions engagable to form a housing that defines an internal cavity with a planar region for receiving an end of flat ribbon cable, a cable opening for accommodating entry into said cavity of an end of the flat ribbon cable, and conductor openings for accommodating entry into said cavity of a plurality of conductor elements;

stationary grounding means mounted in one of said housing portions on one side of said planar region and having ground piercing portions extending toward said planar region and operative to electrically connect together a plurality of conductive wires in the cable in response to relative movement between said one housing portion and the cable in a direction transverse to said planar region; and a plurality of stationary electrically isolated coupling elements mounted in said one housing portion on said one side of said planar region and each having signal piercing portions extending toward said planar region and operative to electrically connect a different one of said conductive wires in the cable to a respective different one of the conductor elements in response to said relative movement between said one housing portion and the cable.

30. An electrical connector according to claim 29 wherein said grounding means is operative to electrically connect together alternate conductive wires in the cable, and said plurality of coupling elements connect to signal conductive wires in the cable that alternate with the alternate conductive wires connected together by said grounding means.

31. An electrical connector according to claim 30 including ground output means for connecting said grounding means to at least one of the conductor elements.

32. An electrical connector according to claim 31 wherein said ground output means comprises means for connecting said grounding means to at least one of the signal conductive wires.

* * * * *